US007310830B2

(12) United States Patent
Kuharcik et al.

(10) Patent No.: US 7,310,830 B2
(45) Date of Patent: Dec. 25, 2007

(54) METHOD OF MESSAGING

(75) Inventors: Joseph Kuharcik, 1211 The Plaza, Riviera Beach, FL (US) 33404; Jill Kuharcik, Palm Beach Gardens, FL (US)

(73) Assignee: Joseph Kuharcik, Riviera Beach, FL (US)

( * ) Notice: Subject to any disclaimer, the term of this patent is extended or adjusted under 35 U.S.C. 154(b) by 0 days.

(21) Appl. No.: 11/277,485

(22) Filed: Mar. 24, 2006

(65) Prior Publication Data

US 2007/0220652 A1 Sep. 27, 2007

(51) Int. Cl.
*A41D 27/08* (2006.01)
*A41B 1/00* (2006.01)

(52) U.S. Cl. ..... 2/246; 2/115; 2/244

(58) Field of Classification Search ..... 2/115, 2/244, 246

See application file for complete search history.

(56) References Cited

U.S. PATENT DOCUMENTS 4,441,271 A * 4/1984 Hutchinson ..... 40/584
4,975,985 A * 12/1990 Stimpson ..... 2/115
4,991,233 A 2/1991 Hall
6,405,381 B1 * 6/2002 Bowman, Jr. ..... 2/170
6,782,554 B1 * 8/2004 Froehlich ..... 2/69
6,880,364 B1 4/2005 Vidolin et al.
6,943,866 B2 9/2005 Redd et al.
2004/0187184 A1 9/2004 Rubin et al.
2004/0216209 A1 * 11/2004 Dickey et al. ..... 2/67
2005/0085189 A1 * 4/2005 Hansen ..... 455/41.2
2005/0086724 A1 * 4/2005 Marsh et al. ..... 2/195.1
2005/0251894 A1 * 11/2005 Marsh et al. ..... 2/195.3
2005/0278825 A1 * 12/2005 Altman ..... 2/115
2006/0048261 A1 * 3/2006 Smith ..... 2/69
2006/0143779 A1 * 7/2006 Lee ..... 2/115

OTHER PUBLICATIONS

HalfBakery; "Expressive Shirts"; http://www.halfbakery.com/idea/Expressive_20shirts; p. 1-3.*
Nappy Head—Funky Twins Slogan T-shirts; http://web.archive.org/web/20051214093512/http://nappyhead.co.uk/acatalog/Funky_Twins_Slogan_T-shirts.html; p. 1-3; as of Dec. 14, 2005.*
Mommy Loves—Twins!; http://web.archive.org/web/20051216103135/http://mommyloves.com/Photo_Gallery4.html; p. 2 of p. 1-3; as of Dec. 16, 2005.*
Nappy Head—Father & Child Twin Sets; http://web.archive.org/web/20051207044951/http://www.nappyhead.co.uk/acatalog/Father_Child_Baby_Twins_Set.html; p. 1-3; as of Dec. 7, 2005.*
Nappy Head—Funky Twins Slogan T-shirts; http://web.archive.org/web/20050402112820/http://www.nappyhead.co.uk/acatalog/Funky_Twins_Slogan_T-shirts.html; p. 1-3; as of Apr. 2, 2005.*

(Continued)

*Primary Examiner*—Gary L. Welch
*Assistant Examiner*—Jena A Sold
(74) *Attorney, Agent, or Firm*—Akerman Senterfitt

(57) ABSTRACT

A method of conveying information or a message, wherein two shirts on two wearers are used with the first part of a message and/or graphic on the first shirt, and the second part of the message and/or graphic on the second shirt. The messages and/or graphics can be on the front or back of the shirt, and both the front and back of the shirts may have complementary messages and/or graphics.

17 Claims, 4 Drawing Sheets

OTHER PUBLICATIONS

Yellow Dolly; http://web.archive.org/web/20000711011716/http://home.earthlink.net/~ltao/tshirt/yellow.html; p. 3 of p. 1-3; as of Jul. 11, 2000.*

A Cup of Ideas—Wedding Accessories; http://web.archive.org/web/20021107042749/http://www.acupofideas.com/wedding19.html; p. 3 of p. 1-4; as of Nov. 7, 2002.*

Twins Help!; Snap! Crackle! Pop!-Kids and Dad Combo; http://web.archive.org/web/20040729142158/http://www.twinshelpstore.com/index.asp?PageAction=VIEWPROD&ProdID=373; p. 1-2; as of Jul. 29, 2004.*

Twins Help!; Snap! Crackle! Pop!-Kids and Dad Combo; http://www.twinshelpstore.com/index.asp?PageAction=VIEWPROD&ProdID=373; p. 1-2; included for picture of T-shirts.*

Masstee-Original Prints; http://www.spreadshirt.com/shop.php?sid=27914&design_1274622; p. 1-2.*

The T-Shirt Guy-Vox; http://thet-shirtguy.vox.com/library/post/find-your-soul-mate-for-valentines-day-start-now.html; p. 1-2.*

CafePress.com; Super Tank; http://www.cafepress.com/shop/supertank/browse/store/trendyteeshirts/321083; p. 1-4.*

MojoLondon: No Added Sugar Blue Snap T-Shirt Set; http://www.mojolondon.co.uk/children/baby/clothing/blue_snap_t-shirt_set_0-6.htm; p. 1-2.* http://web.archive.org/web/20050205230707/http://nflstore.net/cgi-bin/nflgen.pl?tm=WR; NFL Store—Washington Redskins; as of Feb. 5, 2005; p. 2 of 17.* http://www.madison.com/wisconsinstatejournal/special/38853.php; Wisconsin State Journal—Business and Features; "Business is booming for a teen-age sports fan with a great idea"; Dec. 16, 2002.*

* cited by examiner

METHOD OF MESSAGING

CROSS-REFERENCE TO RELATED APPLICATIONS

Not applicable.

FIELD OF THE INVENTION

The present invention relates to clothing systems for displaying coordinated messages.

BACKGROUND OF THE INVENTION

A number of patentable ideas have been associated with T-shirts, such as U.S. Pat. No. 6,880,364, which featured a friendship band with exchangeable closed loop members. Further, U.S. Pat. No. 6,943,866 involved customized printing of messages. U.S. Pat. No. 4,991,233disclosed a garment with various indicia. Further, various information was contained in U.S. Published Application Nos. 2005/0085189, 2004/0187184, and 2004/0216209.

Typically, T-shirts convey an individual message on an individual T-shirt. Of course, many T-shirts are identical, such as those produced to commemorate a race, for example. All participants may have the same shirt and will be identified as a participant in the particular race commemorated by the T-shirt.

In addition, T-shirts identified with a geographical region are popular. Whenever a person wears a T-shirt from such geographical region, it signifies to all who see the shirt that the wearer has been to the geographical place noted, or at least has an interest in such place. The same holds true for schools, favorite sports teams, and for many types of activities as well as products.

While T-shirts with the same institution name may promote some level of togetherness among the wearers, that is not the primary purpose of such T-shirts. In accordance with the goals of the subject invention, T-shirt messaging is designed to promote a method of togetherness and communication or expression not previously identified and understood through the use of T-shirts presently known today. It is understood that T-shirts is being used broadly to also include any similar shirts such as Vee neck, spaghetti strap and muscle shirts.

SUMMARY OF THE INVENTION

In accordance with the subject invention, T-shirts can now create a method of togetherness and communicative expression heretofore unavailable. A first T-shirt for a first wearer will include a message or graphic which may or may not be a complete thought or object in itself. A second T-shirt will be provided for a second wearer which will include a compatible message or graphic which, when read or seen with the first T-shirt, completes a word, a thought, a graphic or some improved intelligible idea lacking unless the two shirts are observed together.

Further, the first and second T-shirts may have messages on the front and back of the shirts which are compatible in a variety of ways. For example, when the second wearer is standing with the first wearer, both facing the same way, a first message may be completed. If the second wearer is turned around so that the back of his or her T-shirt is with the front of the first T-shirt, a different compiled message may be present, or if both wearers are facing away such that the backs of the T-shirts are together, a further compatible message may be delivered.

In this area of sequencing, puzzles or sophisticated advertising messages may be produced, to the entertainment and evocation of those who view the T-shirts and to generate commercial appeal of products and/or services.

Entertaining, religious, commercial and political messages, and messages signifying unity and togetherness, are all available to be displayed such that this invention may be used to fulfill friendship, communication, advertising and purely entertainment goals, all within the imagination of the producer.

In accordance with the above description, it is an object of the subject invention to provide compatible T-shirts which together provide an interesting message or graphic.

It is a further object of the present invention to provide T-shirts that can be worn by individuals such as to promote togetherness between the individuals.

It is but another object of the present invention to provide T-shirts with commercial value that through compatible messaging and graphics provide names, graphics or thoughts which will serve to advertise certain products or services.

It is a further object of the subject invention to provide unintelligible information on one T-shirt which can only be made intelligible by viewing a second T-shirt in combination with the first T-shirt.

DESCRIPTION OF THE DRAWINGS

FIGS. 15 and 16 are seen together the pictorial message is completed;

DETAILED DESCRIPTION

Figure 1:
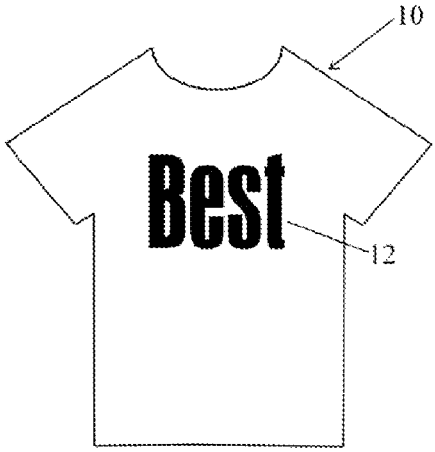
FIG. 1 is a front view of a T-shirt with a message.
Figure 2:
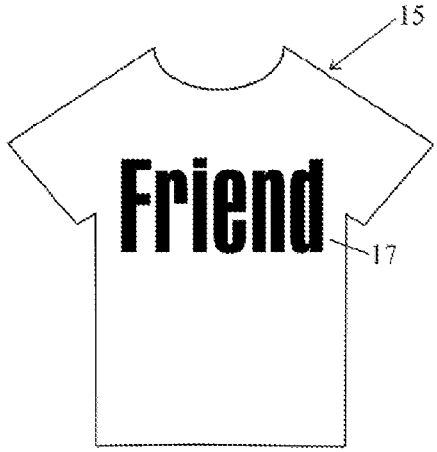
FIG. 2 is the front of a second T-shirt with a compatible message to FIG. 1.

FIG. 1 shows a T-shirt 10 to be worn by one wearer. The T-shirt has a message, in this case the word "BEST" 12, which appears on the front of the T-shirt. In FIG. 2, there is the front of a second T-shirt 15, with the word "FRIEND" 17 on its front. Thus, when the wearer of T-shirt 10 is with the wearer of T-shirt 15, the message "BEST FRIEND" is conveyed to any onlookers as conveying a togetherness between the wearer of T-shirt 10 and the wearer of T-shirt 15. Good friends, lovers, and parent and child will enjoy the message to each other and the message that they are then giving to onlookers when they wear the respective T-shirts 10 and 15 together.

Figure 3:
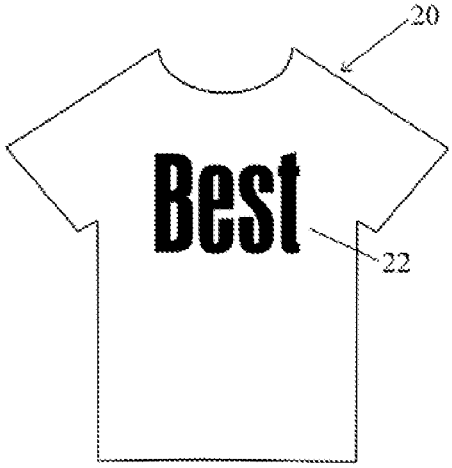
FIG. 3 is a further embodiment shown as the back of the T-shirt of FIG. 2, with a further message.
Figure 4:
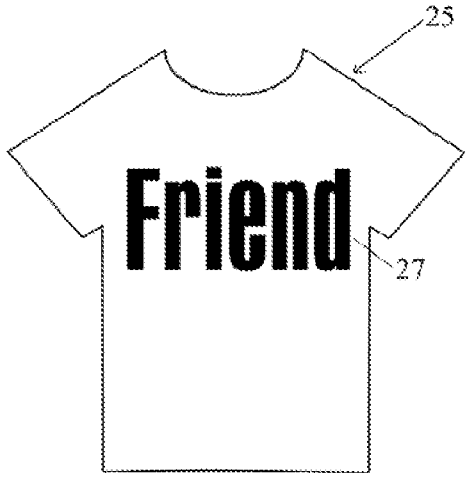
FIG. 4 is a further embodiment shown as is the back of the T-shirt of FIG. 1 with a message compatible to the message of FIG. 3.

FIG. 3 shows the back 20 of the T-shirt of FIG. 2, and on back 20 the message "BEST" 22 is emblazoned thereon by any of the known methods of T-shirt printing. FIG. 4 shows the back of the T-shirt of FIG. 1, and on this back 25 the message 27 "FRIEND" is also given. Thus, the T-shirts convey a completed thought when worn together with the individuals facing one way or the other. Likewise, if the T-shirt of either FIGS. 1 and 4 or FIGS. 2 and 3 is worn alone, there is still a completed message shown, i.e., "BEST FRIEND" reading from front to back or back to front, as the case may be.

Figure 5:
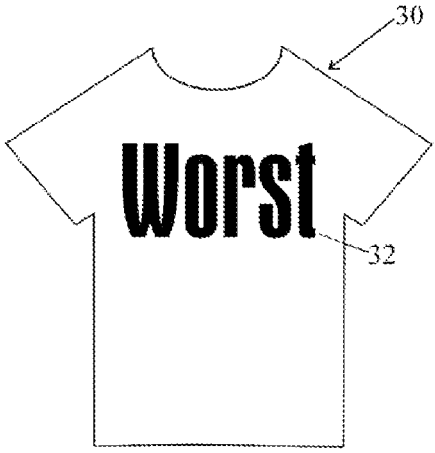
FIG. 5 is an alternate embodiment showing a different back of the T-shirt of FIG. 2, providing a different message.
Figure 6:
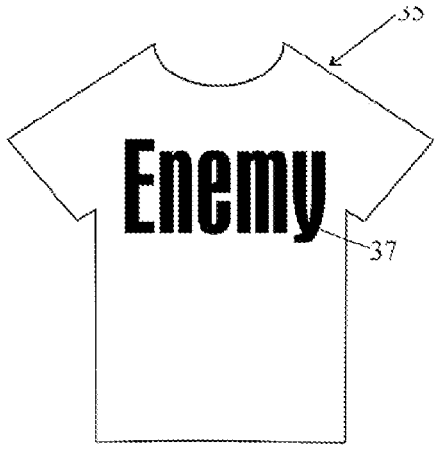
FIG. 6 is the back of the T-shirt of FIG. 1, also showing a different message, but one which is compatible with FIG. 5.

In this type of situation, there is also the possibility of adding humor or confusing or entertaining messages of FIGS. 5 and 6. FIG. 5 shows an alternate embodiment of the back of T-shirt 30 of the T-shirt of FIG. 2. Here the word "WORST" 32 is shown. In FIG. 6 the back of the T-shirt of FIG. 1 is shown with the word "ENEMY" 37 on this back portion 35 of the T-shirt of FIG. 1. Thus, when the wearers of FIGS. 1 and 2 are faced, they convey the message of "BEST FRIEND", but when they are turned away, their back messages are "WORST ENEMY". In this manner, contrary or humorous messages can also be utilized and enjoyed by the wearers and the onlookers.

Figure 7:
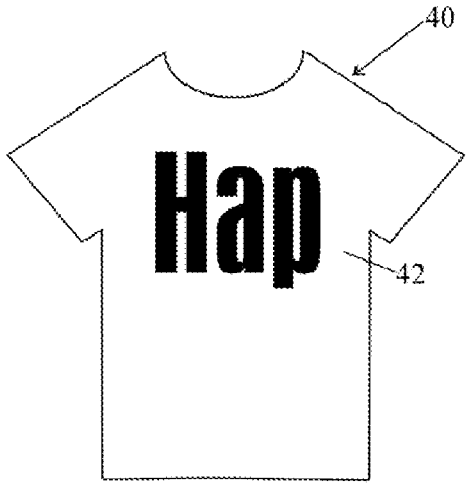
FIG. 7 is the front of another T-shirt with an incomplete message.

It is not necessary that the markings of one or the other T-shirt be intelligible in and of themselves. As shown in FIG. 7, the front of T-shirt 40 has the letters "HAP" 42, which does not have much meaning alone. When a wearer wears the T-shirt of FIG. 8, the front of which is shown as 45 with the letters "PY" 47, a complete word is fashioned to create a message.

Figure 8:
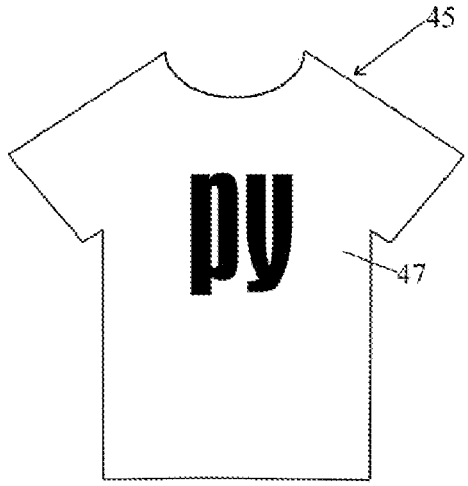
FIG. 8 is the T-shirt of a second wearer, which completes in part the message of the T-shirt of FIG. 7.
Figure 9:
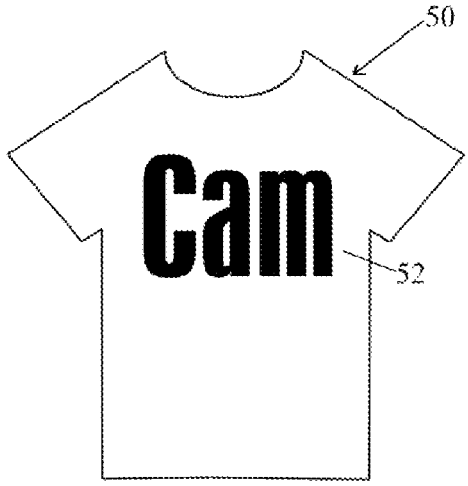
FIG. 9 is the back of the T-shirt of FIG. 8, which has another incomplete message.
Figure 10:
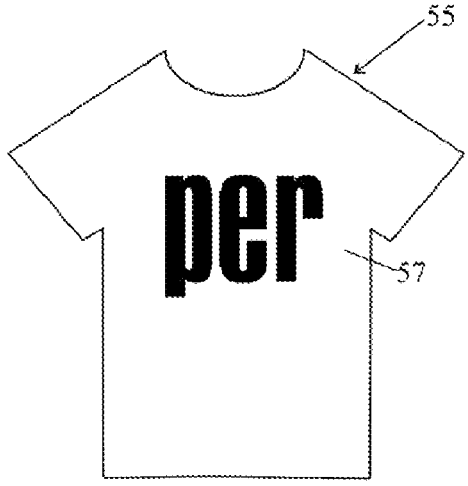
FIG. 10 is the back of the T-shirt of FIG. 7, which completes the message of FIG. 9; and together completes a further message of FIGS. 7, 8, 9, and 10 combined.

That message can be further developed on the back of the respective T-shirts, as FIG. 9 shows the back 50 of the T-shirt of FIG. 8 with the words "CAM" 52. Likewise, the back of the T-shirt of FIG. 7 is shown as T-shirt 55 in FIG. 10 with the words "PER" 57 shown. Thus, the complete message of all four surfaces, i.e., when the front and back of each of the two T-shirts is read, the words "HAPPY CAMPER" are appreciated by onlookers, thus providing enjoyment to the wearers and the onlookers.

Figure 11:
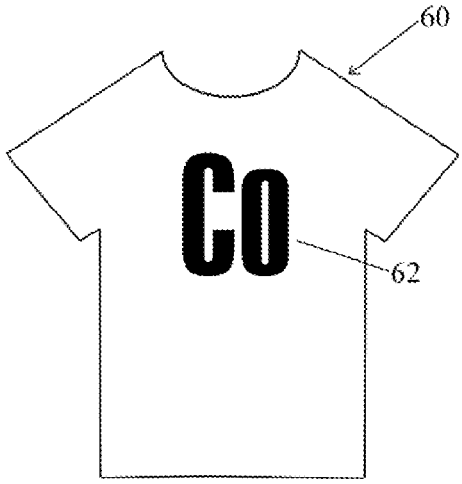
FIG. 11 is the front of a T-shirt which produces a partial type of advertising.
Figure 12:
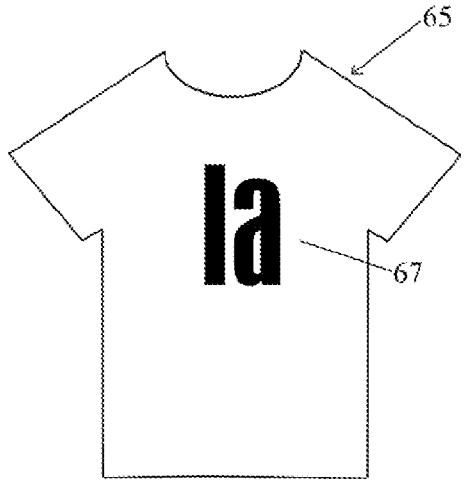
FIG. 12 is the front of a further T-shirt which completes the message of FIG. 11 and creates an advertising purpose.

As shown in FIG. 11, the front of T-shirt 60 has the letters "CO" 62. In FIG. 12 T-shirt front 65 has the letters "LA" 67, thus completing the word "COLA", which can be part of an advertising slogan for products shown in such a manner.

Figure 13:
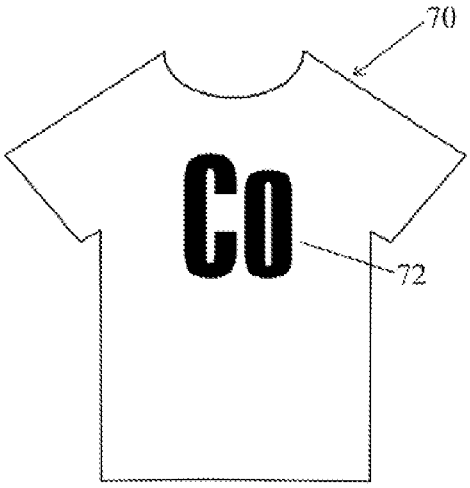
FIG. 13 is the back of the T-shirt of FIG. 12.
Figure 14:
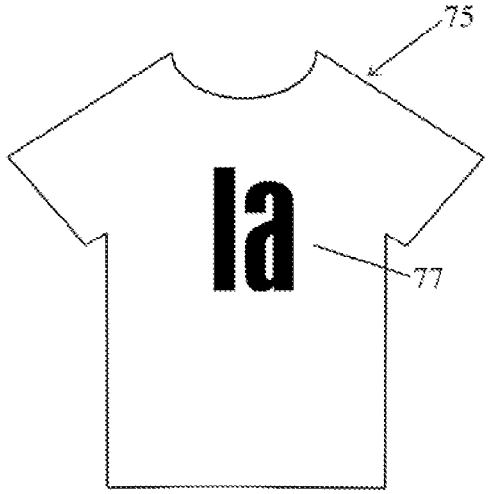
FIG. 14 is the back of the T-shirt of FIG. 11.

As shown in FIG. 13, in a further embodiment the back 70 of T-shirt 65 has the letters "CO" 72, which in combination with the letters "LA" 67 on the front side of T-shirt 65, can also complete the COLA message. Further, back 75 oft-shirt 60 in FIG. 14 can display the letters "LA" 77, and in combination with the letters "CO" 62 displayed on the front oft-shirt 60, can complete the COLA message.

Figure 15:
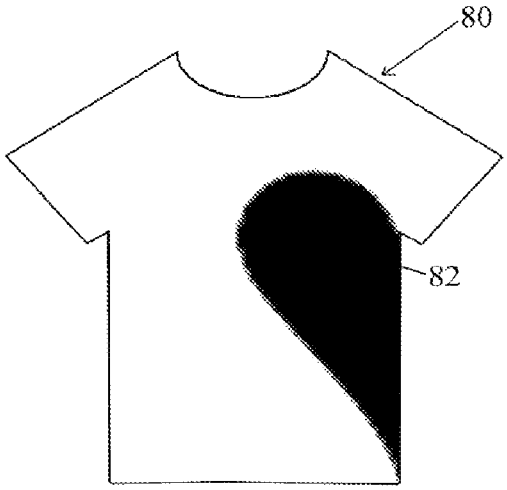
FIG. 15 is the front of a T-shirt which shows an incomplete pictorial message.
Figure 16:
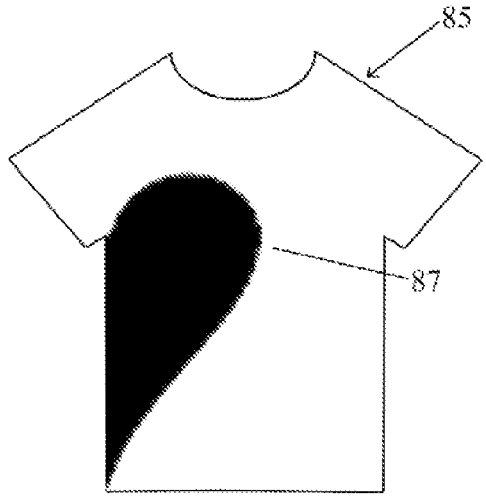
FIG. 16 is the front of a further T-shirt which shows a further incomplete pictorial message, but when

As shown in FIG. 15, the front of T-shirt 80 has half of a heart 82 pictorially depicted. In FIG. 16, the front of T-shirt 85 has the other half of the heart 87 shown to match the depiction of FIG. 15. Thus, the wearers of the T-shirts of FIGS. 15 and 16 when seen together complete the heart 82 and 87 in the eyes of the observers.

Figure 17:
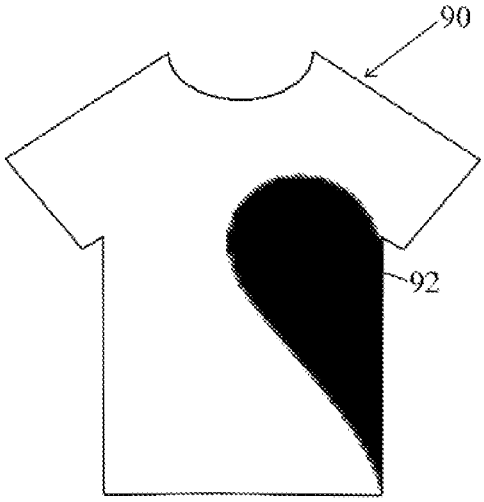
FIG. 17 is the back of the T-shirt of FIG. 16.
Figure 18:
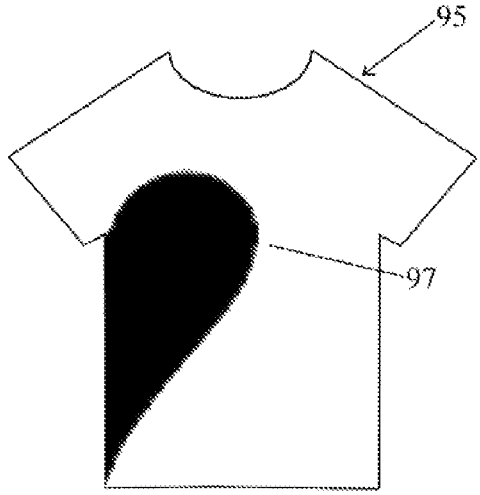
FIG. 18 is the back of the T-shirt of FIG. 15.

In a further embodiment in FIG. 17, the back 90 oft-shirt 85 shows a half heart 92 which completes the half heart 87 from FIG. 16 and in FIG. 18 the half heart 97 of back 95 completes the message with half heart 82 of FIG. 15 and also with the half heart 92 of t-shirt 90 of FIG. 17.

Thus, the t-shirts of a first and second wearer will convey information when read together. This information can be expanded on by having similar or contrary messages on the backs of the T-shirts as well, so that the compatibility is furthered, or in some cases used for contrary and confusing messages to create a more humorous or thought evoking situation as shown in FIGS. 5 and 6.

The information can be compiled so that the first and second wearer create a showing of togetherness, which may be appreciated both by the wearers and the onlookers. Further, various messages such as religious or political messages can be set forth, to the enjoyment, education, benefit, consideration or evocation of the wearers and the onlookers alike.

Further, educational or game-like messages can be produced which will have interesting content for the onlookers, thus providing enjoyment for the wearers.

As in the case of the T-shirt of FIGS. 1 and 4, a message may be conveyed from front to back of the same T-shirt. Thus, the T-shirt will have some meaning when worn by one person who is not in the company of the second person. Also, in the case of, for example, FIG. 8, a wearer of the T-shirt with the letters "PY" 47 on the front and "PER" 57 on the back, shows to onlookers that that person alone is incomplete, thus sending a message which may be perceived as loneliness when that person is in fact alone without the companion wearer.

Thus, through the means of compatible lettering on mating T-shirts, many messages of many different types may be utilized to cause enjoyment or provide education or evocation to onlookers while promoting togetherness of the wearers.

This description has been by way of example of how the invention can be made and carried out. Those of ordinary skill in the art will recognize that various details may be modified in arriving at the other detailed embodiments, and that many of these embodiments will come within the scope of the invention.

Therefore, to apprise the public of the scope of the invention and the embodiments covered by the invention, the following claims are made:

What is claimed is:

1. A method of creating togetherness comprising the steps of:

providing a first T-shirt for a first wearer, the first T-shirt displaying a first message on a front surface of the first T-shirt and a third message on a back surface of the first T-shirt;

providing a second T-shirt for a second wearer, the second T-shirt displaying a second message on a front surface of the second T-shirt and a fourth message on a back surface of the first T-shirt, wherein said first and second message are different and compatible when viewed together and said third and fourth messages are different and compatible when viewed together.

2. The method of claim 1, wherein the fourth message on a back surface of said second T-shirt is identical to the first message on the first T-shirt.

3. The method of claim 2, further comprising, providing a third message on a back surface of said first T-shirt which is identical to the second message on the second T-shirt.

4. The method of claim 1, wherein the first message on the first T-shirt is an incomplete graphic, the second message on the second T-shirt is an incomplete graphic and the combination of the first and second messages form a complete graphic.

5. The method of claim 1, wherein the first message on the first T-shirt is an incomplete word, the second message on the second T-shirt is an incomplete word, and the combination of the first message and the second message form a first complete word.

6. The method of claim 5, wherein the fourth message displays an incomplete word;

wherein the third message displays an incomplete word and the combination of the third message and the fourth message form a second complete word, the second complete word being related to the first complete word.

7. The method of claim 1 wherein at least one of the first and second messages viewed together, the third and fourth messages viewed together, and the first, second, third and fourth messages viewed together comprise an advertisement, a religious message, a political message, an educational message, a humorous message, a commercial message, or a combination thereof.

8. The method of claim 1 wherein at least one of the first and second messages viewed together, the third and fourth messages viewed together, and the first, second, third and fourth messages viewed together promote a showing of togetherness between said first and second wearers and convey said showing of togetherness to an onlooker.

9. The method of claim 1, wherein the first message and the second message form a first compiled message when viewed together and the third message and the fourth message form a second compiled message when viewed together.

10. The method of claim 9, wherein the first compiled message and the second compiled message are different and compatible.

11. The method of claim 1, wherein the second message and the third message are different and compatible when viewed together.

12. The method of claim 1, wherein the second and third messages are different and form a third compiled message when viewed together and the first and fourth message are different and form a fourth compiled message when viewed together.

13. The method of claim 12, wherein the third and fourth compiled messages are different and compatible.

14. The method of claim 1, further comprising positioning the first wearer so that the first wearer is located to the second wearer's right when both wearers are facing the same direction.

15. A method system of displaying messages on a plurality of T-shirts, comprising:

providing a first T-shirt having a first message on a front surface of the first T-shirt and a third message on a back surface of the first T-shirt; and providing a second T-shirt having a second message on a front surface of the second T-shirt and a fourth message on a back of the second T-shirt;

wherein the first message and the second message are different and compatible when viewed together and the third message and the fourth message are different and compatible when viewed together.

16. The method of claim 15, wherein the first message is an incomplete word, the second message is an incomplete word and the combination of the first and second messages form a complete word.

17. The method of claim 16, wherein the first message is an incomplete graphic, the second message is an incomplete graphic and the combination of the first and second messages form a complete graphic when viewed together.

* * * * *